United States Patent [19]

Urani et al.

[11] 4,224,592

[45] Sep. 23, 1980

[54] MINIATURE PLUG-IN FUSE ASSEMBLY AND METHOD OF MANUFACTURE

[75] Inventors: Angelo Urani; Aldino J. Gaia, both of St. Louis, Mo.

[73] Assignee: McGraw-Edison Company, Elgin, Ill.

[21] Appl. No.: 892,743

[22] Filed: Apr. 3, 1978

[51] Int. Cl.[2] ..... H01H 85/02

[52] U.S. Cl. ..... 337/198; 29/623; 29/DIG. 15; 337/260

[58] Field of Search ..... 337/198, 142, 186, 187, 337/194, 201, 206, 241, 255, 260, 264, 265; 29/623, DIG. 15, 414, 417; 339/19

[56] References Cited

U.S. PATENT DOCUMENTS

| | | | |
|---|---|---|---|
| 3,775,723 | 11/1973 | Mamrick et al. | 337/187 X |
| 3,775,724 | 11/1973 | Mamrick et al. | 337/187 X |
| 4,056,884 | 11/1977 | Williamson et al. | 337/198 |
| 4,080,039 | 3/1978 | Ahroni et al. | 337/198 X |
| 4,099,320 | 7/1978 | Schmidt et al. | 29/DIG. 15 |

*Primary Examiner*—R. L. Moses

*Attorney, Agent, or Firm*—Jon C. Gealow; Ron LaPorte; Roy Ekstrand

[57] ABSTRACT

A miniature plug-in fuse assembly is provided in which a pair of conductive legs and a fuse link interconnecting them are integrally formed from fusible metal. An insulating casing wholly encloses the fuse link and a portion of the conductive legs, the casing having a hollow body with a cover which does not extend beyond the body in its longer dimension. The cover is secured to the body by a retaining arrangement employing the ends of the conductive legs, which also provides for the insertion of a test current to test the fuse link. Other ends of the legs extend through the body to provide plug-in members. The legs are fastened to the body by protruding lugs on the plug-in members and projecting stops on the portion of the legs in the casing. A method for making the fuse assembly of this invention involves a series of die stamping steps to form the legs and fuse link from a continuous strip of fusible metal and mounting the legs and fuse link in the casing.

21 Claims, 11 Drawing Figures

FIG-1
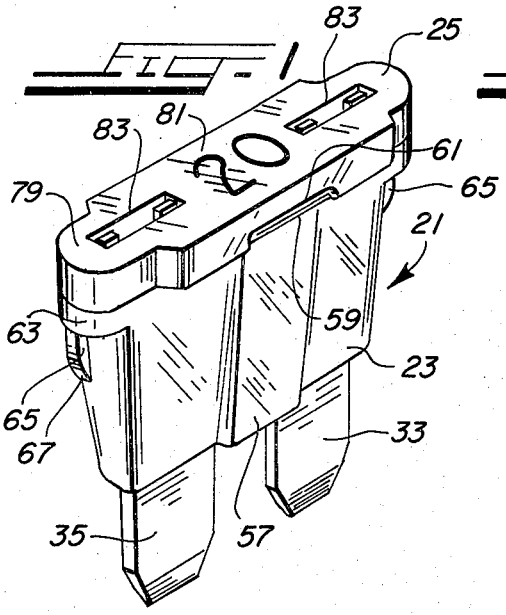
FIG-2
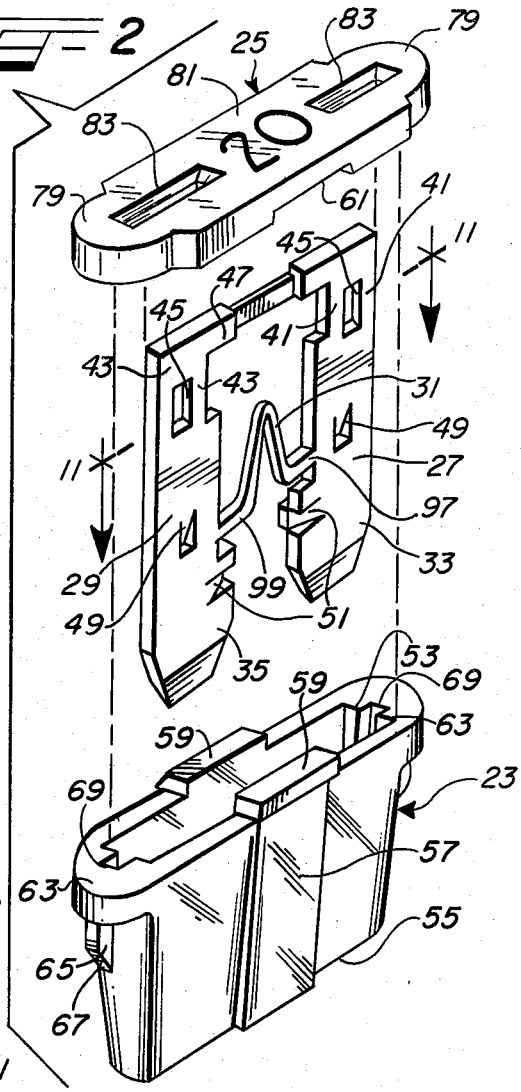
FIG-3
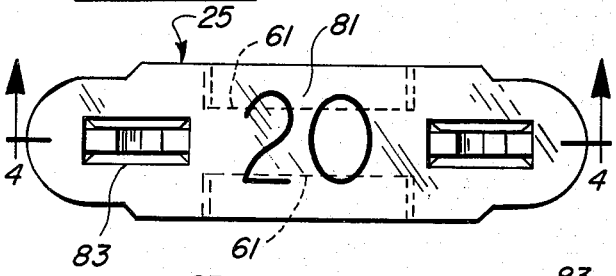
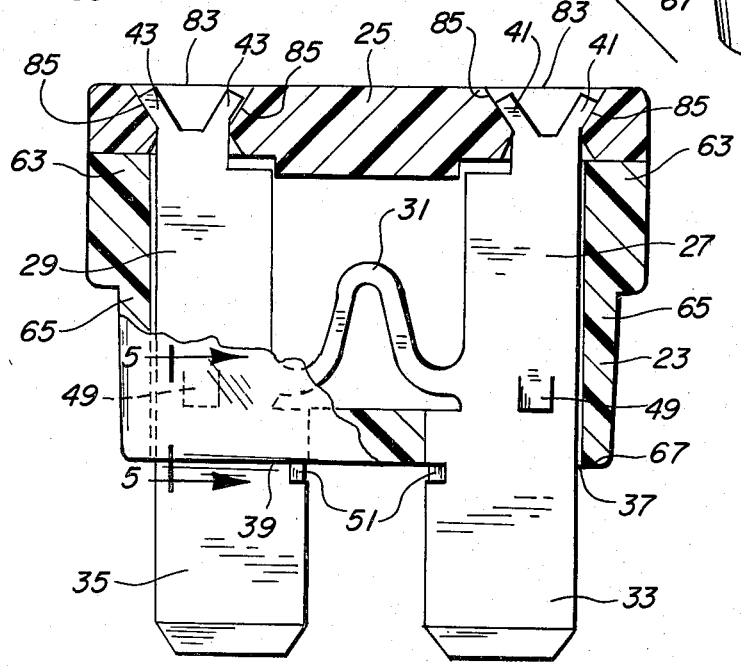
FIG-4
FIG-5
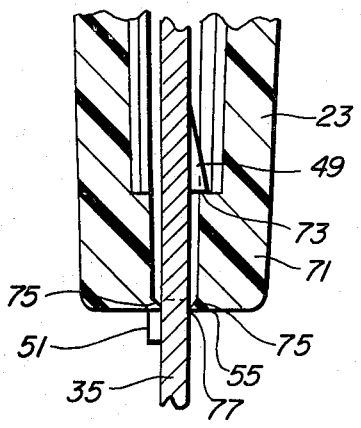

87
89
91
93
95
97
99
101
103
23
25
27
29
31
33
35
41
43
45
47
49
51
57

MINIATURE PLUG-IN FUSE ASSEMBLY AND METHOD OF MANUFACTURE

BACKGROUND OF THE INVENTION

1. Field of the Invention

The present invention relates to fuses of a small physical size, and more particularly, this invention relates to miniature plug-in fuses, such as those utilized in automobiles, having conductors and a fuse link stamped from the same strip of fusible metal.

1. Description of the Prior Art

To prevent undesired heating and potentially damaging and dangerous overload conditions, a fuse or fuse link is inserted in series with a conductor so that it will melt at a desired current level. Such a fuse link is usually made of a metal or alloy (fusible metal) which has a significantly lower melting point than the copper conductors.

In general, a fuse should be of the smallest physical size permitting required levels of current flow and yet assuring interruption of the flow of electrical current when desired. Various types of fuses, including some for interrupting relatively low levels of current in relatively low voltage applications, have been used. The most prevalent type of fuses in the latter category are those having a sealed glass cylindrical envelope surrounding a fusible link which is electrically connected to the terminal connectors capping each end. This type of fuse is in common use in automobiles. Such a fuse suffers from several disadvantages. It is comparatively bulky and fragile; it is difficult to handle; and it has its terminals exposed so that undesired contact is possible.

Less bulky fuses have been developed, but in the process of doing so, additional drawbacks were introduced. Some of these fuses had links exposed where they could be contaminated. Also, a user trying to replace a blown fuse was subject to risk of electrical shock or injury from contact with the hot melted fusible metal. Other types enclosed the fuse link and provided a handle, but were difficult to extract because of their compactness. In addition, the fuse link could not be visually examined while the fuse was in a terminal block (and in some cases could not be visually inspected at all). Further, these fuses were not economical. Many of the prior art types of fuses involved soldering the fusible link to the terminal connections, which were often of a dissimilar metal. In such fuses, corrosion or deficient soldering techniques frequently results in hot spots at the solder connection, causing an undesirable alteration of the current response or "blowing" characteristics of the fuse. Since fuses are selected by a designer on the basis of the fuse "blowing" characteristic (i.e., the time required to interrupt current flow at given voltage and current levels), any variation in the fuse blowing characteristic is particularly undesirable.

Another attempt to eliminate or diminish many of the drawbacks and difficulties of prior art devices involves constructing the conductive elements entirely of fusible metal. The terminal connections are in a coplanar configuration and the conductive elements are partially enclosed in a transparent plastic housing open at the end from which the terminals (or plug-in members) extend. One type of such a fuse is made by Littelfuse, Inc., and disclosed in a number of patents (e.g., U.S. Pat. No. 3,909,767—Williamson et al.; U.S. Pat. No. 3,962,782—Williamson et al.; U.S. Pat. No. 4,023,264—Schmidt, Jr. et al.; U.S. Pat. No. 4,023,265—Aryamane; and U.S. Pat. No. 4,040,175—Williamson et al.). While such fuses are useful, there are areas in which improvement is desirable. A number of these stem from the open housing at the terminal end. The fusible link is not wholly enclosed and thus can easily become contaminated, such as by becoming coated with foreign matter. Any coating of the fuse link alters the heat transfer characteristics, and may alter the conductive characteristics, of the fuse link. Such an alteration will necessarily alter the blowing characteristic of the fuse and result in melting of the fuse link at undesired current levels, either too high or too low. Further, the open housing design is unable to produce any substantial pressurization during blowing of the fuse link, which would enhance arc snuffing; nor will the housing retain the melted fusible link metal within the fuse. Further, the open housing does not provide as much support for the protruding plug-in members or terminal portions as a closed structure, so that misalignment is more likely.

Another problem relates to the fact that the insulating housing of the fuse may be strengthened by a protruding shoulder surrounding its outer closed end. In some types of fuse assemblies, this shoulder is essentially at right angles to the sides of the housing, and when the fuse is inserted in a terminal block, conductors in a harness may be introduced between the shoulder at the end of the fuse and the terminal block. When this occurs, the fuse can be inadvertently dislodged from the block by manipulation of the harness while wiring.

The method of manufacturing a miniature fuse with an open plastic housing and conductors and fuse link progressively formed from a continuous strip of fusible metal, the conductors being surrounded by the housing and secured to the housing by causing the plastic to flow through apertures in the fuse metal, is relatively economical. However, the manner of affixing the housing to the fuse metal has some drawbacks in that the necessity of heating the plastic to bond or to flow, or both, limits the rate at which fuses may be produced to considerably less than the rate that is achievable with metal working operations. To achieve rates comparable to metal working operations, it is necessary to have a multi-stage operation, adding complexity to the method, or multiple process lines. A related, more serious, drawback of this method of affixing the housing to the fusible metal is that the state of technology is such that, compared to metal forming, the reliability of the fastening is limited and separation of parts may be encountered by the user.

SUMMARY OF THE INVENTION

With the present invention there is provided a miniature plug-in fuse assembly in which contamination of the fuse link is diminished, to enhance functional reliability, and the melted metal of the fusible link is contained within the fuse housing. This fuse assembly may be easily and economically manufactured.

The miniature plug-in fuse assembly of the present invention includes a pair of electrically conductive legs with a fuse link extending therebetween. A casing having a body and a cover wholly encloses the fuse link and a portion of the conductive legs in the vicinity of the fuse link. Ends of the conductive legs extend through appropriate openings in the closed end of the casing body (as opposed to the open end of the body closed by the cover) to provide plug-in members. The plug-in members fit into appropriate receptacles where the fuse assembly is to be inserted, such as on a terminal board.

The conductive legs and the fuse link may be integrally formed from a strip of fusible metal, with the fuse link having a reduced thickness relative to the thickness of the conductive legs. Fastening of the conductive legs in the casing body is achieved by use of protruding lugs formed on the plug-in members and projecting stops formed on the portion of the conductive lugs in the casing body. The lugs engage the outer surface of the casing body to prevent movement of the conductive legs in a direction to draw the plug-in members toward the interior of the casing. Similarly, the stops engage a shoulder in the interior of the body, such as the solid section at the closed end of the casing body through which the openings for the plug-in members are formed, to prevent movement in a direction to further extend the plug-in members. Both the lugs and the stops may be stamped from the fusible metal of the conductive legs.

Both the body and the cover of the casing are formed from an electrically insulating and comparatively rigid material. It is desirable to make at least a portion of the body transparent to permit visual inspection of the fuse link. In the preferred embodiment disclosed herein, both the body and cover are formed of a tinted transparent plastic.

The body is hollow with a closed end and an open end. The body has a generally rectangular cross section and a relatively small thickness compared to the other dimensions of the rectangular cross section. Openings for the plug-in members are located in the closed end of the body, and the portion of the body defining the openings comes to a relatively thin engaging surface to provide flexibility, so that the plug-in members are received with an interference fit. The cover fits over the open end of the body. A retaining structure for securing the cover to the body includes inwardly converging orifices formed in the cover and a pair of prongs formed at the ends of the conductive legs opposite the plug-in members. Splaying of the prongs to engage the converging sides of the orifices provides the desired cover retaining function. At the same time, a current may be introduced through the prongs to test the fuse link while the casing is closed.

Rounded shoulders are formed on the outer surface of the body adjacent the open end thereof. The cover has corresponding rounded ends, a keying arrangement being provided to properly align the cover so that neither of the ends extends beyond the outer limits of the shoulders, and hence the cover cannot be accidentally forced from the body, nor does it provide any projecting portion that could lead to dislodgement of the fuse assembly.

Vertical slots or grooves are formed along the sides of the body, in the interior surfaces, to receive the sides of the conductive legs and hence support and guide the legs.

In manufacturing the fuse assembly, a strip of fusible metal has a reduced thickness section formed down the middle thereof. Conductive legs and an interconnecting fuse link are stamped from the strip, the fuse link being stamped from the reduced thickness section. The projecting stops are stamped from the conductive legs and limit the insertion of the conductive legs into the casing body. The protruding lugs are formed from the fusible metal of the plug-in members and engage the outer surface of the casing body. In the preferred embodiment disclosed herein, the lugs are stamped out and then flattened prior to insertion of the conductive legs into the body. After insertion has been completed, the lugs are then caused to again protrude.

A pair of prongs are stamped out of the end of each conductive leg opposite the plug-in member of that leg. Preferably, a web of material is left to connect the pairs of prongs to retain the conductive legs in alignment and protect the fuse link. After the conductive legs have been fastened to the body, the web is removed. The cover is then placed on the body, with the prongs being inserted into the orifices. Then the prongs are splayed to secure the cover to the body.

In this fashion, an economical miniature plug-in fuse assembly of enhanced functional reliability, which prevents expulsion of the melted fusible metal of a fuse link, is provided. The fuse assembly is easily manufactured and is securely held together without external fastening arrangements—the fusible metal itself provides the fastening and retaining functions. Further, the cover is protected from accidental dislodgement and the plug-in members extend through the openings with an interference fit to enhance sealing.

These and other objects, advantages and features of this invention will hereinafter appear, and for purposes of illustration, but not of limitation, an exemplary embodiment of the subject invention is shown in the appended drawing.

BRIEF DESCRIPTION OF THE DRAWING

FIG. 1 is a perspective view of a miniature plug-in fuse assembly constructed in accordance with this invention.

FIG. 2 is an exploded perspective view of the miniature plug-in fuse assembly of FIG. 1.

FIG. 3 is a top plan view of the fuse assembly of FIG. 1.

FIG. 4 is an enlarged cross-sectional view taken along line 4—4 of FIG. 3.

FIG. 5 is an enlarged partial cross-sectional view taken along line 5—5 of FIG. 4.

DETAILED DESCRIPTION OF THE PREFERRED EMBODIMENT

Figures 6, 7, 8, 9, 10, 11:
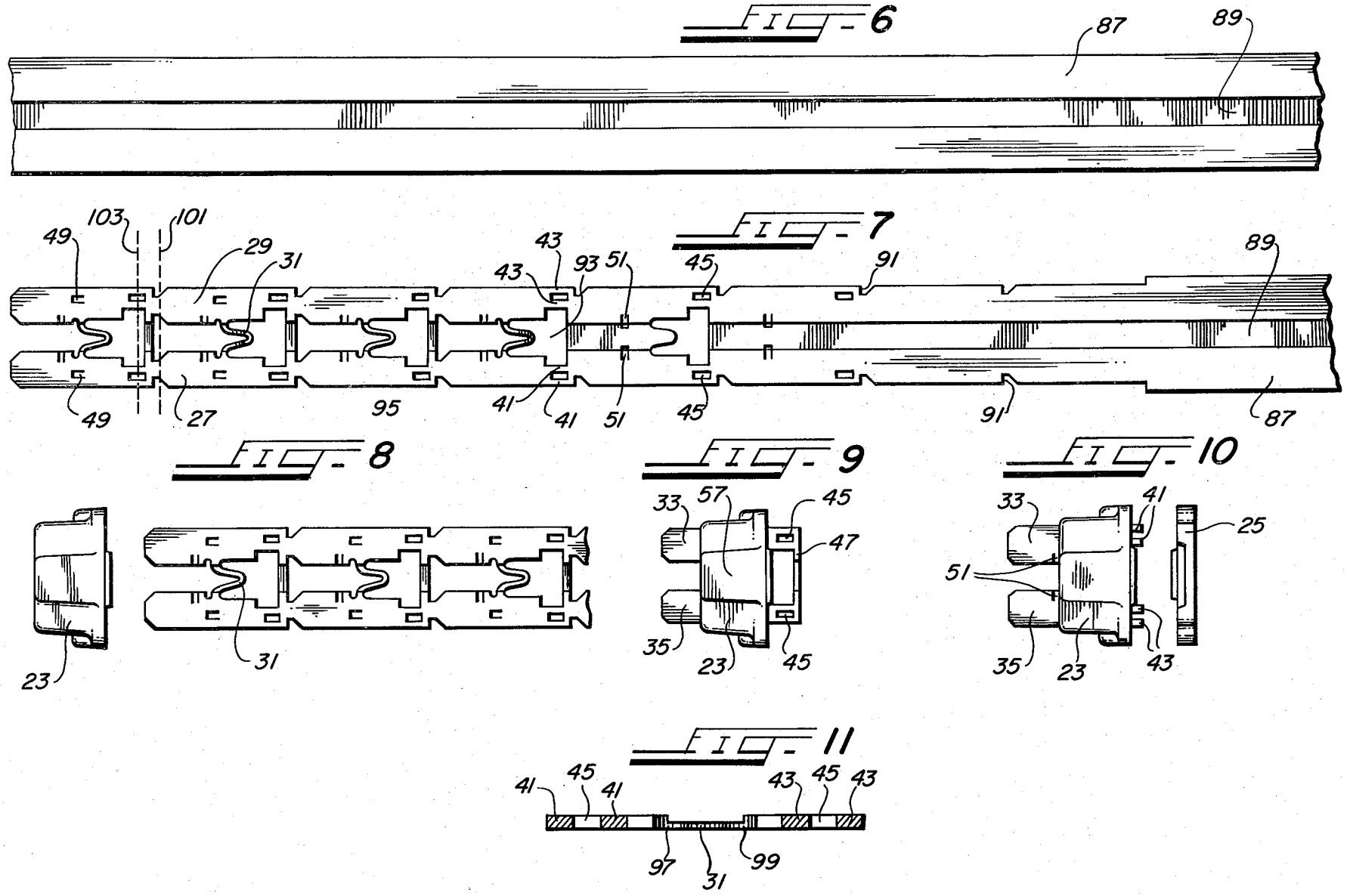
FIG. 6 is a plan view of a continuous strip of fusible metal utilized in the manufacture of miniature plug-in fuse assembly of FIG. 1.
FIG. 7 is a plan view of the strip of FIG. 6 showing the progressive die forming steps utilized in manufacturing the fuse assembly of the invention.
FIG. 8 is a plan view illustrating the strip of FIG. 6 in conjunction with the body after partial processing.
FIG. 9 is a plan view illustrating the strip of FIG. 8 inserted into the body.
FIG. 10 is a plan view illustrating the cover and body immediately prior to securing of the cover to the body.
FIG. 11 is an enlarged cross-sectional view taken along line 11—11 of FIG. 2.

A miniature plug-in fuse assembly constructed in accordance with the present invention is illustrated in FIG. 1. The fuse assembly includes a casing 21, which has a body 23 and a cover 25. The casing 21 should be relatively rigid. In addition, it is desirable to have at least a portion of body 23 transparent to permit visual inspection of the fuse elements in the casing. Also, it is desirable to have the cover 25 transparent to permit visual inspection from the top. In this preferred embodiment, both the body 23 and the cover 25 are constructed of a tinted plastic. Both polycarbonate and polysulfate materials have been used successfully.

With reference to FIG. 2, a pair of conductive legs 27 and 29 and a fuse link 31 may be seen. In this FIGURE, the conductive legs 27 and 29 and fuse link 31 are illustrated in a form prior to the fully assembled form of FIG. 4.

Conductive legs 27 and 29 and fuse link 31 are integrally stamped from a plated fusible metal. Preferably, the fuse link 31 has a reduced thickness in comparison to the conductive legs in order to provide the desired fuse characteristics. Also, fuse link 31 can be of various shapes. Although a single loop form is shown in the preferred embodiment, fuse link 31 could be straighter or of a different shape entirely, or it could have multiple loops (e.g., an "S" shape). The particular shape and size will depend upon the fuse characteristics that are desired.

Conductive legs 27 and 29 are essentially flat with a generally rectangular shape. At one end, each of the conductive legs 27 and 29 has a plug-in member 33 and 35, respectively. Plug-in members 33 and 35 extend through corresponding openings 37 and 39, respectively, in body 23 of casing 21 with an interference fit. The ends of plug-in members 33 and 35 are appropriately tapered to fit in corresponding receptacles, such as in a terminal board.

At the other ends of conductive legs 27 and 29 there are formed prongs 41 and 43. Prongs 41 and 43 are formed by the punch-outs 45, although the pairs of prongs 41 and 43 remain connected by a web 47 of fusible metal. This web is removed after the conductive legs 27 and 29 are fastened in body 23.

Projecting stops 49 are stamped from the fusible metal of the portions of conductive legs 27 and 29 that are located in casing 21. Similarly, protruding lugs 51 are stamped from the fusible metal of plug-in members 33 and 35.

As may be seen best in FIG. 2, body 23 is hollow with an open end 53 and a closed end 55. Body 23 has a generally rectangular cross section and a thickness that is small relative to the dimensions of the cross section. Ribs 57 are formed on the front and back surfaces of body 23. These ribs 57 provide a strengthening function. In addition, ends 59 of ribs 57 mate with corresponding openings 61 in cover 25 to provide a keying function.

Rounded protruding shoulders 63 are formed at the top of body 23 adjacent open end 53 thereof. A depending buttress 65 extends from each of the shoulders 63. These buttresses 65 have a curvilinear end portion 67 to guide the casing 21 into the receptacle provided for the fuse assembly.

A slot or groove 69 is formed in each side of body 23 on the interior thereof. These slots 69 receive the sides of conductive legs 27 and 29 to support and guide the legs. It may be noted that body 23 has a slight taper from the open end 53 to the closed end 55 thereof. Slots 69 permit the use of a tight fit for the conductive legs at the closed end 55 while permitting an easy insertion at the open end 53.

Referring to FIG. 5, a solid section 71 is located at the closed end 55 of body 23. This solid section provides a shoulder 73 engaged by the projecting stops 49. Of course, this shoulder could be otherwise provided, if so desired.

At the portion of section 71 that defines openings 37 and 39, tapered edges 75 provide a relatively small engaging surface 77, as may be best seen in FIG. 5. This structure of edges 75 results in some flexibility, which means that the surfaces 77 may engage the plug-in members 33 and 35 with an interference fit.

Cover 25 is generally flat and has a generally rectangular shape with rounded ends 79. Rounded ends 79 are shaped to conform to rounded shoulders 63 on body 23. By use of the keying members, ends 59 and openings 61, it may be assured that cover 25 is properly positioned such that rounded ends 79 do not extend beyond the outer limits of rounded shoulders 63. It may be desirable to make the cover 25 slightly shorter in its longer dimension to insure this relationship, and hence prevent any accidental dislodging of cover 25.

If so desired, the rating of the fuse may be shown on the cover 25 at point 81, as demonstrated here by the numeral "20," referring to a twenty ampere fuse protection level.

Orifices 83 extend through the cover 25. These orifices 83 converge inwardly from the top of cover 25 toward the hollow interior of body 23. Prongs 41 and 43 are inserted into orifices 83 and then splayed to engage converging sides 85 of the orifices 83. This secures top or cover 25 to body 23, while yet permitting the introduction of a current through prongs 41 and 43 to test fuse link 31.

In manufacturing the fuse assembly, the body 23 and cover 25 are appropriately produced in the form drawn and described by any appropriate procedure, such as injection molding. The formation of the conductive legs 27 and 29 and fuse link 31 is then achieved by a series of progressive die stamping steps.

As illustrated in FIG. 6, a strip 87 of fusible metal is provided with a reduced thickness strip 89 down the center. The series of progressive die stamping steps is illustrated in FIG. 7, without showing any "dead" steps (i.e., steps in which no actual stamping occurs). Of course, it is not necessary that all of the actions of this method be taken in precisely the order shown, as some variations might be possible.

The first step is to trim strip 87 to the desired width. Notches 91 are then punched to define the length of conductive legs 27 and 29. At the next stage, punch-outs 45 are introduced to define prongs 41 and 43. In this preferred embodiment, the protruding lugs 51 are also stamped out and then flattened back into the plane of conductive legs 27 and 29 at successive steps of the process. At the next step, an opening 93 is punched out to define one side of fusible link 31 and the inner prongs of the pairs of prongs 41 and 43. At the following stage, another opening 95 is punched out to complete the definition of fuse link 31. As may be seen from the cross section of FIG. 11, the ends 97 and 99 of fuse link 31 are not reduced as in the center fusible section thereof but have the same thickness as the conductive legs 27 and 29. At the next step, the projecting stops 49 are stamped out.

In FIGS. 8–10, the insertion of the conductive legs 27 and 29 and fuse link 31 into casing 21 is illustrated. Upon insertion of conductive legs 27 and 29 from the position of FIG. 8 to that of FIG. 9, the insertion continues until terminated by stops 49 engaging shoulder 73. At this point, lugs 51 are caused to protrude to lock legs 27 and 29 in casing body 23. Web 47, shown still in place in FIG. 9, is then separated from the strip by severing along dash line 101 in FIG. 7. Finally, severing along dash line 103 in FIG. 7 separates web 47 from prongs 41 and 43. Cover 25 is then placed on body 23 as shown in FIG. 10, and prongs 41 and 43 are then splayed to the positions shown in FIG. 4.

It should be understood that various modifications, changes and variations may be made in the arrangement, operation and details of construction of the elements disclosed herein without departing from the spirit and scope of this invention.

We claim:

1. A miniature plug-in fuse assembly comprising:
a pair of electrically conductive legs;
a fuse link extending between said conductive legs;
an insulating casing having a pair of openings preformed therein, including a hollow body and a cover, a pair of openings preformed in the hollow body, said cover closing the end of the body opposite said openings to wholly enclose a portion of said conductive legs and said fuse link;
a projecting plug-in member formed at one end of each of said conductive legs;
said plug-in members of said conductive legs extending from said casing through said pair of openings; and
fastening means for securing said conductive legs and said fuse link in a fixed location with respect to said hollow body, said fastening means further including retaining means on said legs for securing said cover to said hollow body;
whereby an easily produced and mechanically secure fuse assembly is provided with said fuse link totally enclosed to preclude the adverse effects of having the interior of said casing open to the atmosphere.

2. A miniature plug-in fuse assembly as claimed in claim 1 wherein said cover extends no further than the outer limits of said body at the ends of its longer dimension.

3. A miniature plug-in fuse assembly comprising:
a pair of electrically conductive legs;
a fuse link extending between said conductive legs;
an insulating casing wholly enclosing a portion of said conductive legs and said fuse link, said casing comprising a hollow body in which said portion of said legs and said link are located and which contains said openings, said casing further comprising a cover for closing the end of said body opposite said openings for said plug-in members, said cover containing orifices into which the ends of said conductive legs opposite said plug-in members extend to secure said cover to said body and to permit the introduction of a current to test said fuse link;
a projecting plug-in member formed at one end of each of said conductive legs;
a pair of openings formed at one end of said casing through which said plug-in members of said condcutive legs extend; and
fastening means for securing said conductive legs and said fuse link in a fixed location with respect to said casing, whereby an easily produced and mechanically secure fuse assembly is provided with said fuse link totally enclosed to preclude the adverse effects of having the interior of said casing open to the atmosphere.

4. A miniature plug-in fuse assembly as claimed in claim 3 wherein:
said orifices are inwardly converging; and
a pair of prongs are formed at said ends opposite said plug-in members of each of said conductive legs, said prongs being splayed to engage the converging sides of said orifices.

5. A miniature plug-in fuse assembly comprising:
a pair of electrically conductive legs;
a fuse link extending between said conductive legs;
an insulating hollow body enclosing a portion of each of said conductive legs and said fuse link;
a projecting plug-in member formed at one end of each of said conductive legs;
a pair of openings formed at one end of said body through which said plug-in members extend with an interference fit;
a protruding lug formed on each of said plug-in members, said lugs engaging the outer surfaces of said body to prevent movement of said conductive legs in the direction to draw said plug-in members into the interior of said body;
a projecting stop formed on the portion of each of said conductive legs located in the interior of said body;
an interior shoulder in said body, said projecting stops engaging said interior shoulder to prevent said legs from moving in the direction to further extend said plug-in members;
an insulating cover for the end of said body opposite said openings for said plug-in members; and
retaining means on said legs for securing said cover to said body to provide a closed casing while permitting selective testing of said fuse link.

6. A miniature plug-in fuse assembly as claimed in claim 5 wherein said fuse link has a reduced thickness compared to the thickness of said conductive legs and is integrally formed of fusible metal with said conductive legs.

7. A miniature plug-in fuse assembly as claimed in claim 5 wherein portions of said body defining said openings are formed with a relatively thin flexible engaging surface to provide the interference fit.

8. A miniature plug-in fuse assembly as claimed in claim 5 wherein said shoulder comprises the solid section at said closed end of said body through which said openings are formed.

9. A miniature plug-in fuse assembly as claimed in claim 5 wherein:
said cover is generally flat with rounded ends; and
rounded shoulders are formed on said body, said rounded ends of said cover not extending beyond the outer limits of said rounded shoulders on said body.

10. A miniature plug-in fuse assembly as claimed in claim 9 and further comprising keying means to accurately position said cover on said body.

11. A miniature plug-in fuse assembly as claimed in claim 5 and further comprising vertically extending slots formed on the interior sides of said hollow body to receive the edges of said conductive legs.

12. A miniature plug-in fuse assembly as claimed in claim 5 wherein said retaining means comprises:
inwardly converging orifices formed in said cover into which the ends of said conductive legs opposite said plug-in members extend; and
a pair of prongs formed on the ends of said conductive legs opposite said plug-in members, said prongs being splayed to engage the converging sides of said orifices.

13. A miniature plug-in fuse assembly as claimed in claim 5 wherein said body has at least a portion thereof transparent to permit visual inspection of said fuse link.

14. A miniature plug-in fuse assembly comprising:
a pair of electrically conductive legs;

a fuse link extending between said conductive legs, said conductive legs and said fuse link being unitarily stamped from a fusible metal with said fuse link having a reduced thickness;

a hollow transparent plastic body having a generally rectangular cross-section and a thickness small in comparison to the cross-section dimension, said body enclosing a portion of each of said conductive legs and said fuse link, said hollow body having an open end and a closed end;

first ends of said conductive legs comprising plug-in members extending from said body;

a pair of openings formed in said closed end of said body through which said plug-in members extend, portions of said body defining said openings being formed with a relatively thin flexible engaging surface to provide an interference fit for said plug-in members;

a protruding lug stamped from the inner side of each of said plug-in members to contact the outer surface of said body in order to prevent said conductive legs from being moved in a direction to draw said plug-in members toward the interior of said body;

a solid section at the closed end of said body through which said openings are formed providing a shoulder on the interior of said body;

a projecting stop stamped from each of said conductive legs adjacent said shoulder to engage said shoulder and prevent said conductive legs from moving in a direction to further extend said plug-in members;

a vertically extending slot formed in the interior of said hollow body along each side thereof to receive the edges of said conductive legs;

a generally flat cover to close the open end of said hollow body;

a rounded reinforcing shoulder formed on the external surface of each side of said body adjacent the open end thereof;

each end of said cover being rounded to generally match the shape of said reinforcing shoulder without extending beyond the outer limits of said shoulders;

a pair of orifices formed in said cover, said orifices having sides that inwardly converge from the top of said cover; and a pair of extending prongs formed on the second end of each of said conductive legs, each of said pairs of prongs being splayed to engage said conveying sides of said orifices to secure said cover to said body while permitting the introduction of a current through said prongs to test said fuse link.

15. A method of manufacturing a miniature plug-in fuse assembly comprising the steps of:

stamping out of a strip of fusible metal a pair of legs with a fuse link extending therebetween;

forming a pair of prongs at one end of each of the legs;

forming a projecting stop from the fusible metal of each leg;

inserting the legs into the open end of a hollow insulating body, with the ends of the legs opposite the prongs extending through appropriate openings in the closed end of the body to provide plug-in members, the insertion continuing until the stops engage corresponding shoulders in the body;

forming a protruding lug from each of the plug-in members immediately adjacent the outer surface of the body to prevent movement of the legs in the direction opposite to the direction of insertion;

placing an insulating cover with a pair of inwardly converging orifices over the open end of the hollow body with the prongs extending through the orifices; and splaying the prongs to engage the sides of the orifices to secure the cover to the body to provide a closed casing, while permitting testing of the fuse link by introduction of a current through the prongs.

16. A method as claimed in claim 15 and further comprising the step of reducing the thickness of the strip of fusible metal in the area where the fuse link is formed.

17. A method as claimed in claim 15 and further comprising the steps of:

retaining a web of fusible metal between the pronged ends of the legs to fix the relative positions of the legs and protect the fuse link; and removing the web after the legs have been inserted into the body.

18. A method as claimed in claim 15 wherein the step of forming the protruding lugs comprises:

stamping out the lugs prior to insertion of the legs into the body;

flattening the lugs back into the plane of the legs prior to insertion of the legs into the body; and causing the lugs to protrude from the plane of the legs after the plug-in members are extended through the openings.

19. A method of manufacturing a miniature plug-in fuse assembly comprising the steps of:

forming a hollow plastic body with an open end and a substantially closed end containing a pair of openings;

forming a plastic cover having a pair of inwardly converging orifices for the open end of the body;

forming a reduced thickness portion down the center of a strip of fusible metal;

stamping a pair of legs and a fuse link extending therebetween out of the strip of fusible metal, the fuse link being formed from the reduced thickness portion of the strip;

forming a pair of prongs at one end of each of said legs, a web of fusible metal being retained to fix the relative position of the legs and protect the fuse link;

forming a projecting stop from the fusible metal of each leg;

inserting the legs into the open end of the hollow body with the ends of the legs opposite the prongs extending through the openings to provide plug-in members, the insertion continuing until the stops engage the inner surface of the substantially closed end of the body;

forming a protruding lug from each of the plug-in members immediately adjacent the outer surface of the body to prevent movement of the legs in the direction opposite to the direction of insertion;

removing the web of fusible metal from the pronged ends of the legs;

placing the cover over the open end of the body with the prongs extending through the orifices; and splaying the prongs to engage the sides of the orifices to secure the cover to the body to provide a closed casing, while permitting testing of the fuse by introduction of a current through the prongs.

20. A method as claimed in claim 19 wherein the step of forming the protruding lugs comprises:

stamping out the lugs prior to insertion of the legs into the body;

flattening the lugs back into the plane of the legs prior to insertion of the legs into the body; and causing the lugs to protrude from the plane of the legs after the plug-in members are extended through the openings.

21. A miniature plug-in fuse assembly comprising:

a pair of electrically conductive legs;

a fuse link extending between said conductive legs;

an insulating casing wholly enclosing a portion of said conductive legs and said fuse link;

a projecting plug-in member formed at one end of each of said conductive legs;

a pair of openings formed at one end of said casing through which said plug-in members of said conductive legs extend; and fastening means for securing said integral formation of said conductive legs and said fuse link in a fixed location with respect to said casing comprising a protruding lug formed on each of said plug-in members, said lugs engaging the outer surface of said casing to prevent movement of said conductive legs in a direction tending to draw said plug-in members toward the interior of said casing, said fastening means also comprising a projecting stop formed on the portion of each of said conductive legs located in the interior of said casing, said fastening means further comprising a shoulder on the interior of said casing with said stops engaging said shoulder to prevent said legs from moving in a direction to further extend said plug-in members, said protruding lugs, projecting stops, and shoulder securing said conductive legs and said fuse link in a fixed location with respect to said casing whereby an easily produced and mechanically secure fuse assembly is provided with said fuse link totally enclosed to preclude the adverse effects of having the interior of said casing open to the atmosphere.

* * * * *